US011230905B2

(12) United States Patent
Helms et al.

(10) Patent No.: US 11,230,905 B2
(45) Date of Patent: Jan. 25, 2022

(54) BUOYANCY ASSIST TOOL WITH WAFFLE DEBRIS BARRIER

(71) Applicant: Halliburton Energy Services, Inc., Houston, TX (US)

(72) Inventors: Lonnie Carl Helms, Humble, TX (US); Min Mark Yuan, Katy, TX (US); Mayur Narain Ahuja, Friendswood, TX (US); Ishwar Dilip Patil, Spring, TX (US); Byong Jun Kim, Cypress, TX (US); Rajesh Parameshwaraiah, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 107 days.

(21) Appl. No.: 16/701,728

(22) Filed: Dec. 3, 2019

(65) Prior Publication Data

US 2021/0164324 A1 Jun. 3, 2021

(51) Int. Cl.
*E21B 34/06* (2006.01)
*E21B 33/12* (2006.01)

(52) U.S. Cl.
CPC ..... *E21B 34/063* (2013.01); *E21B 33/12* (2013.01)

(58) Field of Classification Search
CPC ..... E21B 34/063; E21B 33/12
See application file for complete search history.

(56) References Cited

U.S. PATENT DOCUMENTS 3,463,351 A 8/1969 Mills
3,779,263 A 12/1973 Edwards et al.
3,980,134 A 9/1976 Amancharla
4,457,376 A 7/1984 Carmody et al.
5,150,756 A 9/1992 Hassanzadeh
5,479,986 A 1/1996 Gano et al.
5,765,641 A 6/1998 Shy et al.
5,826,661 A 10/1998 Parker et al.
6,026,903 A 2/2000 Shy et al.
6,076,600 A * 6/2000 Vick, Jr. ..... E21B 33/1208 166/192
6,161,622 A 12/2000 Robb et al.
6,324,904 B1 12/2001 Ishikawa et al.
6,450,263 B1 9/2002 Schwendemann
(Continued)

FOREIGN PATENT DOCUMENTS

EP 0566290 A1 10/1993
EP 0681087 B1 9/2000
(Continued)

OTHER PUBLICATIONS

International Search Report and Written Opinion dated Aug. 14, 2018, issued in PCT Application No. PCT/US2017/062528.
(Continued)

*Primary Examiner* — Steven A MacDonald
(74) *Attorney, Agent, or Firm* — McAfee & Taft

(57) ABSTRACT

A downhole apparatus comprises a casing string with a removable plug therein to block flow therethrough. A flow barrier is positioned in the casing below the removable plug and the removable plug and the flow barrier define a buoyancy chamber therebetween. A debris barrier positioned above the removable plug has a plurality of fragments interspersed in a stretchable material and includes a frangible disc.

20 Claims, 5 Drawing Sheets

(56) References Cited

U.S. PATENT DOCUMENTS

| | | | | |
|---|---|---|---|---|
| 6,505,685 | B1 | 1/2003 | Sullaway et al. | |
| 6,622,798 | B1 | 9/2003 | Rogers et al. | |
| 6,651,748 | B2 | 11/2003 | Sullaway et al. | |
| 6,672,389 | B1 | 1/2004 | Hinrichs | |
| 6,758,281 | B2 | 7/2004 | Sullaway et al. | |
| 7,270,191 | B2 | 9/2007 | Drummond et al. | |
| 8,505,621 | B2 | 8/2013 | Telfer et al. | |
| 9,033,055 | B2 | 5/2015 | Mccoy et al. | |
| 9,309,752 | B2 | 4/2016 | Talley et al. | |
| 9,441,437 | B2 | 9/2016 | Fripp et al. | |
| 9,441,446 | B2 | 9/2016 | Fripp et al. | |
| 9,518,445 | B2 | 12/2016 | Noske | |
| 9,540,904 | B2 | 1/2017 | Petrowsky | |
| 9,593,542 | B2 | 3/2017 | Getzlaf et al. | |
| 10,138,707 | B2 | 11/2018 | Tolman et al. | |
| 10,323,478 | B2 | 6/2019 | Berscheidt et al. | |
| 10,883,333 | B2 * | 1/2021 | Giroux | E21B 29/02 |
| 10,989,013 | B1 * | 4/2021 | Helms | E21B 33/126 |
| 2002/0185273 | A1 | 12/2002 | Aronstam et al. | |
| 2003/0116324 | A1 | 6/2003 | Dawson et al. | |
| 2003/0217844 | A1 | 11/2003 | Moyes | |
| 2008/0073075 | A1 | 3/2008 | Buyers et al. | |
| 2008/0115942 | A1 | 5/2008 | Keller et al. | |
| 2010/0270031 | A1 | 10/2010 | Patel | |
| 2010/0294376 | A1 | 11/2010 | O'Brien et al. | |
| 2011/0042099 | A1 | 2/2011 | Williamson, Jr. et al. | |
| 2011/0253392 | A1 | 10/2011 | May et al. | |
| 2012/0111566 | A1 | 5/2012 | Sherman et al. | |
| 2014/0174757 | A1 * | 6/2014 | Fripp | E21B 29/02 166/376 |
| 2014/0216756 | A1 * | 8/2014 | Getzlaf | E21B 33/146 166/376 |
| 2014/0224505 | A1 | 8/2014 | Ramon | |
| 2014/0338923 | A1 * | 11/2014 | Fripp | E21B 33/1208 166/376 |
| 2015/0107843 | A1 | 4/2015 | Talley et al. | |
| 2015/0129205 | A1 | 5/2015 | Hofman et al. | |
| 2015/0240596 | A1 | 8/2015 | Horwell | |
| 2016/0177668 | A1 | 6/2016 | Watson et al. | |
| 2016/0333658 | A1 | 11/2016 | Keshishian et al. | |
| 2017/0096875 | A1 | 4/2017 | Ravensbergen et al. | |
| 2017/0138153 | A1 | 5/2017 | Getzlaf et al. | |
| 2017/0342253 | A1 * | 11/2017 | Galizio | C08K 3/36 |
| 2018/0003004 | A1 | 1/2018 | Norman et al. | |
| 2018/0058179 | A1 | 3/2018 | Nuryaningsih et al. | |
| 2018/0080308 | A1 | 3/2018 | Dedman et al. | |
| 2018/0219200 | A1 | 8/2018 | Albukrek et al. | |
| 2018/0262127 | A1 | 9/2018 | Gooneratne et al. | |
| 2018/0371869 | A1 * | 12/2018 | Kellner | E21B 21/103 |
| 2019/0128081 | A1 | 5/2019 | Ross et al. | |
| 2019/0352994 | A1 | 11/2019 | Giroux | |
| 2019/0352995 | A1 * | 11/2019 | Giroux | E21B 29/02 |
| 2020/0240214 | A1 * | 7/2020 | Getzlaf | E21B 17/14 |
| 2020/0284121 | A1 * | 9/2020 | Helms | E21B 17/00 |
| 2021/0062598 | A1 * | 3/2021 | Yuan | E21B 34/063 |
| 2021/0062616 | A1 * | 3/2021 | Parameshwaraiah | E21B 43/10 |
| 2021/0123317 | A1 * | 4/2021 | Yuan | E21B 33/12 |
| 2021/0131222 | A1 * | 5/2021 | Helms | E21B 34/06 |

FOREIGN PATENT DOCUMENTS

| | | | |
|---|---|---|---|
| JP | 6551001 | B2 | 7/2019 |
| WO | 2014098903 | A1 | 6/2014 |
| WO | 2015073001 | A1 | 5/2015 |
| WO | 2016176643 | A1 | 11/2016 |
| WO | 2019099046 | A1 | 5/2019 |

OTHER PUBLICATIONS

International Search Report and Written Opinion dated Sep. 19, 2019, issued in PCT Application No. PCT/US2018/066889.
International Search Report and Written Opinion dated Sep. 19, 2019, issued in PCT Application No. PCT/US2018/067161.
International Search Report and Written Opinion dated Aug. 14, 2019, issued in PCT Application No. PCT/US2019/064051.
International Search Report and Written Opinion dated Jan. 14, 2020, issued in PCT Application No. PCT/US2019/027502.
International Search Report and Written Opinion dated Feb. 5, 2020, issued in PCT Application No. PCT/US2019/0031541.
International Search Report and Written Opinion dated Jan. 21, 2020, issued in PCT Application No. PCT/US2019/028508.
International Search Report and Written Opinion dated May 25, 2020, issued in PCT Application No. PCT/US2019/056206.
International Search Report and Written Opinion dated May 26, 2020, issued in PCT Application No. PCT/US2019/059757.
International Search Report and Written Opinion dated Jan. 16, 2020, issued in PCT Application No. PCT/US2019/027625.
International Search Report and Written Opinion dated Oct. 27, 2020, issued in PCT Application No. PCT/US2020/039399.
International Search Report and Written Opinion dated Feb. 24, 2021, issued in PCT Application No. PCT/US2020/040157.
International Search Report and Written Opinion dated Jul. 21, 2020, issued in PCT Application No. PCT/US2019/059864.
International Search Report and Written Opinion dated Jul. 23, 2020, issued in PCT Application No. PCT/US2019/061714.
International Search Report and Written Opinion dated Aug. 11, 2020, issued in PCT Application No. PCT/US2019/065862.
International Search Report and Written Opinion dated Aug. 31, 2020, issued in PCT Application No. PCT/US2020/012307.

* cited by examiner

BUOYANCY ASSIST TOOL WITH WAFFLE DEBRIS BARRIER

The length of deviated or horizontal sections in well bores is such that it is sometimes difficult to run well casing to the desired depth due to high casing drag. Long lengths of casing create significant friction and thus problems in getting casing to the toe of the well bore. Creating a buoyant chamber in the casing utilizing air or a fluid lighter than the well bore fluid can reduce the drag making it easier to overcome the friction and run the casing to the desired final depth.

DESCRIPTION

Figure 1:
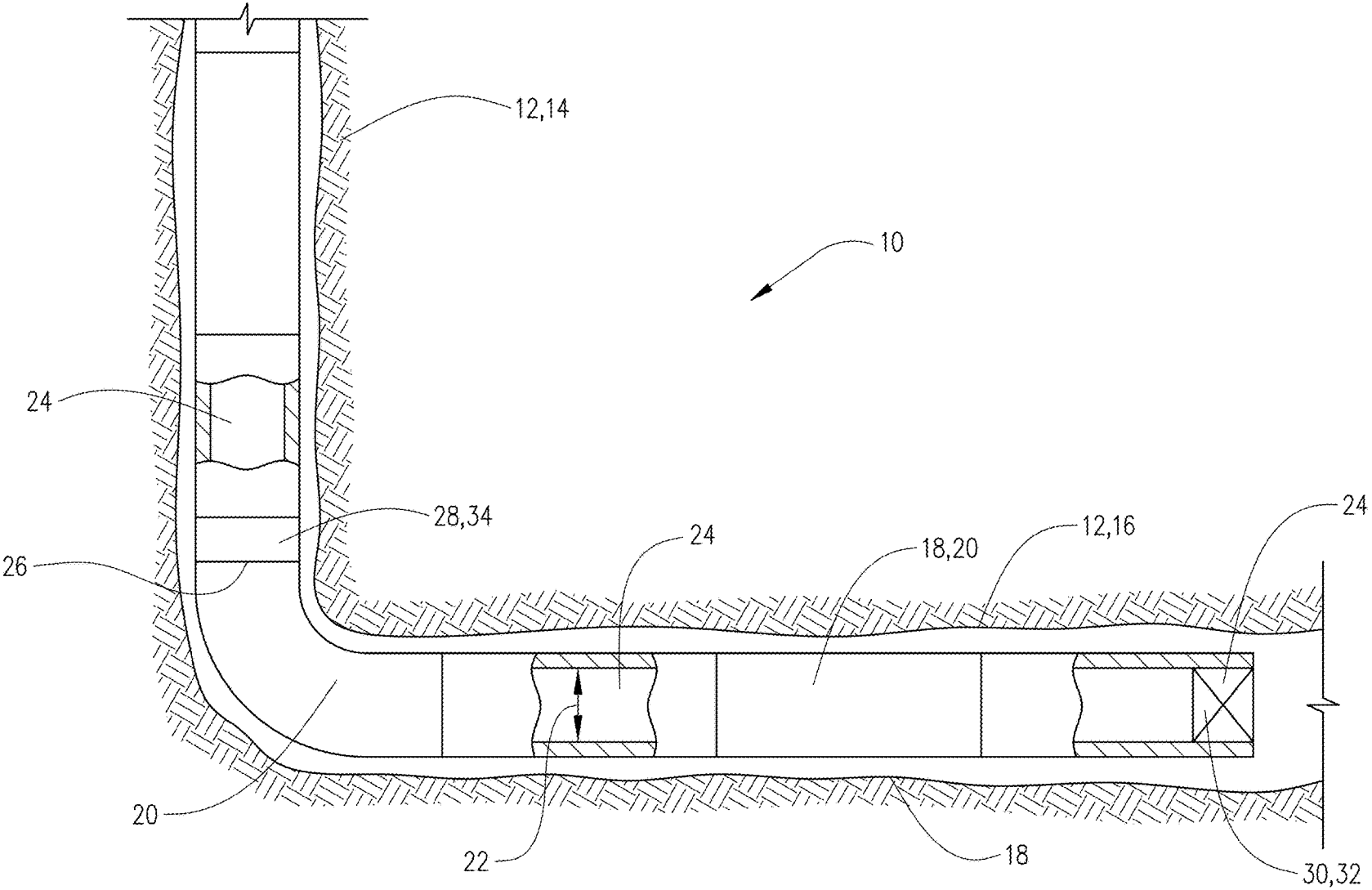
FIG. 1 is a schematic view of an exemplary well bore with a well casing including a buoyancy chamber therein.
Figure 2:
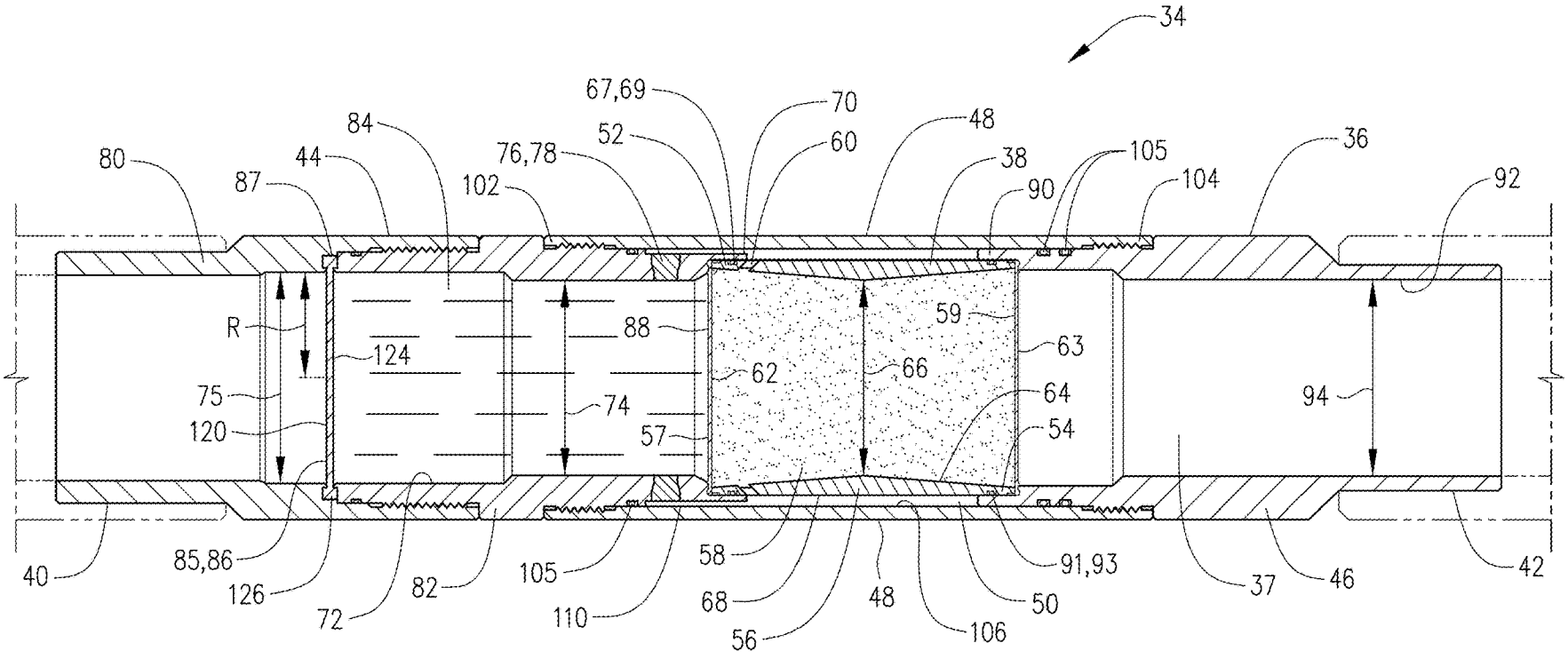
FIG. 2 is a cross section of a buoyancy assist tool of the current disclosure.

The following description and directional terms such as above, below, upper, lower, uphole, downhole, etc., are used for convenience in referring to the accompanying drawings. One who is skilled in the art will recognize that such directional language refers to locations in the well, either closer or farther from the wellhead and the various embodiments of the inventions described and disclosed here may be utilized in various orientations such as inclined, deviated, horizontal and vertical.

Referring to the drawings, a downhole apparatus 10 is positioned in a well bore 12. Well bore 12 includes a vertical portion 14 and a deviated or horizontal portion 16. Apparatus 10 comprises a casing string 18 which is made up of a plurality of casing joints 20. Casing joints 20 may have inner diameter or bore 22 which defines a central flow path 24 therethrough. Well casing 18 defines a buoyancy chamber 26 with upper end or boundary 28 and lower end or boundary 30. Buoyancy chamber 26 will be filled with a buoyant fluid which may be a gas such as nitrogen, carbon dioxide, or air but other gases may also be suitable. The buoyant fluid may also be a liquid such as water or diesel fuel or other like liquid. The important aspect is that the buoyant fluid has a lower specific gravity than the well fluid in the well bore 12 in which casing 18 is run. The choice of gas or liquid, and which one of these is used is a factor of the well conditions and the amount of buoyancy desired.

Lower boundary 30 may comprise a float device such as a float shoe or float collar 32. As is known, such float devices will generally allow fluid flow downwardly therethrough but will prevent flow upwardly into the casing. The float devices are generally a one-way check valve. The float device 30 is thus a fluid barrier that will be configured such that it will hold the buoyant fluid in the buoyancy chamber 26 until additional pressure is applied after the release of the buoyancy fluid from the buoyancy chamber. The upper boundary 28 is defined by a buoyancy assist tool as described herein.

Buoyancy assist tool 34 includes an outer case 36 defining flow path 37 therethrough that is connectable in casing string 18. Buoyancy assist tool 34 comprises a plug assembly 38 that is connected to and positioned in outer case 36. Buoyancy assist tool 34 has upper end 40 and lower end 42. Buoyancy assist tool 34 is connectable in the casing string at the upper and lower ends 40 and 42 thereof and forms a part of the casing string 18 lowered into well bore 12.

Outer case 36 comprises an upper outer case 44 and a lower outer case 46. A connecting shield 48 is connected to and extends between upper outer case 44 and lower outer case 46. Outer case 36 and plug assembly 38 define an annular space 50 therebetween.

Plug assembly 38 has upper end 52 and lower end 54. Plug assembly 38 is connected to upper outer case 44 at the upper end 52 thereof and to lower outer case 46 at the lower end 54 thereof. The plug assembly may be threadedly connected or connected by other means known in the art. Plug assembly 38 may comprise a plug housing 56 with upper and lower ends 52 and 54 which are the upper and lower ends of the plug assembly 38. A degradable plug or degradable core 58 is fixed in housing 56. Degradable core 58 has upper end 57 and lower end 59, which may be for example coincident with the upper and lower ends 52 and 54 of plug housing 56. The degradable core may be a matrix of sand and salt but can be other degradable substances that can be degraded with fluids or other means once the casing string 18 is lowered into the well bore to a desired location in the well. Plug housing 56 has a plurality of housing ports 60 defined through the wall thereof. Housing ports 60 communicate the annular space 50 with the degradable plug or core 58 so that fluid passing therethrough can contact degradable plug 58 and can degrade the plug to remove it from plug housing 56 to create a full bore flow path therethrough.

Buoyancy assist tool 34 may include an upper impermeable membrane 62 positioned across upper end 57 of degradable plug 58 and a lower impermeable membrane 63 positioned across the lower end 59 of degradable plug 58. Membranes 62 and 63 will prevent fluid thereabove from contacting the degradable plug at the upper end of the plug assembly 38 prior to the time casing string 18 is placed at the desired location in well bore 12. Likewise, the impermeable membrane 63 will prevent fluid in the buoyancy chamber 26 from contacting the degradable plug 58 until such time as degradation of the plug is desired. Upon degradation of the plug 58 the membranes 62 and 63 will be easily ruptured by fluid flowing through the casing string 18, including outer case 36.

Plug housing 56 has an inner surface 64 defining a diameter 66 and has an outer surface 68. In the embodiment described diameter 66 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

Upper end 40 of buoyancy assist tool 34 is likewise the upper end of upper outer case 44. Upper outer case 44 has a lower end 70. Plug assembly 38 is connected at its upper end 52 to the lower end 70 of upper outer case 44. Outer surface 68 of plug housing 56 may have a groove 67 with an O-ring seal 69 therein to sealingly engage an inner surface of upper outer case 44. Upper outer case 44 has inner surface 72 which defines an inner diameter 74 that is a minimum inner diameter of upper outer case 44. In the embodiment shown upper outer case 44 has a port 76 therethrough. Inner diameter 74 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

A rupture disc or other rupturable membrane 78 is positioned in port 76 in upper outer case 44. Rupture disc 78 will prevent flow through port 76 until a desired or predetermined pressure is reached in casing string 18. Upon reaching the predetermined pressure the rupture disc 78 will rupture and fluid will be communicated from casing string 18 through port 76 into annular space 50. Fluid will pass from annular space 50 through housing ports 60 and will contact the degradable plug 58. The fluid passing therethrough may be referred to as a degrading fluid. The degrading fluid may be any fluid utilized to degrade the degradable plug and may be water or other degrading fluid.

The degrading fluid is in fluid chamber 84, which has upper end 86 and lower end 88. Upper membrane 62 prevents the fluid in fluid chamber 84 from contacting degradable plug 58 prior to the rupturing of rupture disc 78. Upper outer case 44 may be a two-piece outer case comprising an upper portion 80 that is threadedly and sealingly connected to lower portion 82. Lower portion 82 connects to plug assembly 38 as shown in the figures. Upper outer case 44 may define fluid chamber 84 which is a closed fluid chamber 84. Fluid chamber 84 has a debris barrier 85 that extends across upper end 86 thereof. Fluid in fluid chamber 84 is thus trapped between debris barrier 85 and the upper membrane 62. There are certain formations in which it is not desirable to pump water. In those instances oil or another fluid other than water may be utilized to fracture or otherwise treat the formation. Where, for example, water is the degrading fluid, but not the treatment fluid, water will be contained in the fluid chamber 84 such that upon reaching the appropriate position in the well oil or other fluid may be pumped through the casing string 18 so that the water in fluid chamber 84 will contact the degradable plug 58 as further described herein. The water in fluid chamber 84 passes into and from annular space 50 through ports 60 in plug housing 56 and will contact the degradable plug 58 until it is degraded or dissolved.

Lower outer case 46 has upper end 90 and a lower end which is the lower end 42 of buoyancy assist tool 34. Upper end 90 of lower outer case 46 is connected to lower end 54 of plug assembly 38. Outer surface 68 of plug housing 56 may have a groove 91 with an O-ring seal 93 therein to sealingly engage lower outer case 46. Lower outer case 46 has inner surface 92 defining an inner diameter 94. Inner diameter 94 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

Connecting sleeve 48 has upper end 102 and lower end 104. Connecting sleeve 48 is connected at it upper end 102 to an outer surface of upper outer case 44 and is connected at its lower end 104 to an outer surface of lower outer case 46. O-ring seals 105 may be positioned in grooves in the outer surfaces of the upper and lower outer cases 44 and 46 respectively to sealingly engage an inner surface 106 of connecting shield 48. Inner surface 106 of connecting shield 48 defines an inner diameter 108. An annular passageway 110 is defined by and between upper outer case 44 and connecting shield 48. Annular passageway 110 communicates fluid delivered through port 76 into annular space 50. Fluid is communicated through ports 60 so that it will contact degradable plug 58 to dissolve or degrade the plug.

Figure 3:
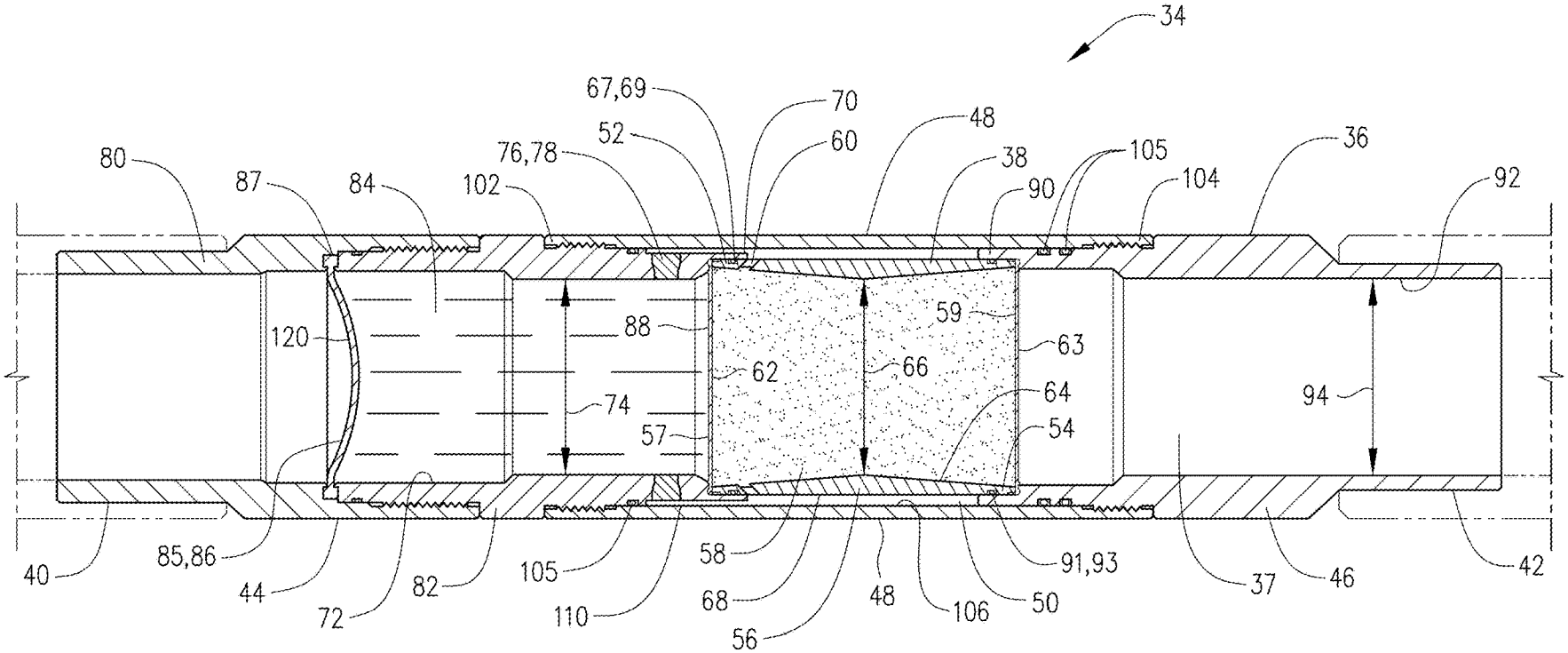
FIG. 3 is a cross section of a buoyancy assist tool of FIG. 2 after pressure has been applied to the debris barrier.
Figure 4:
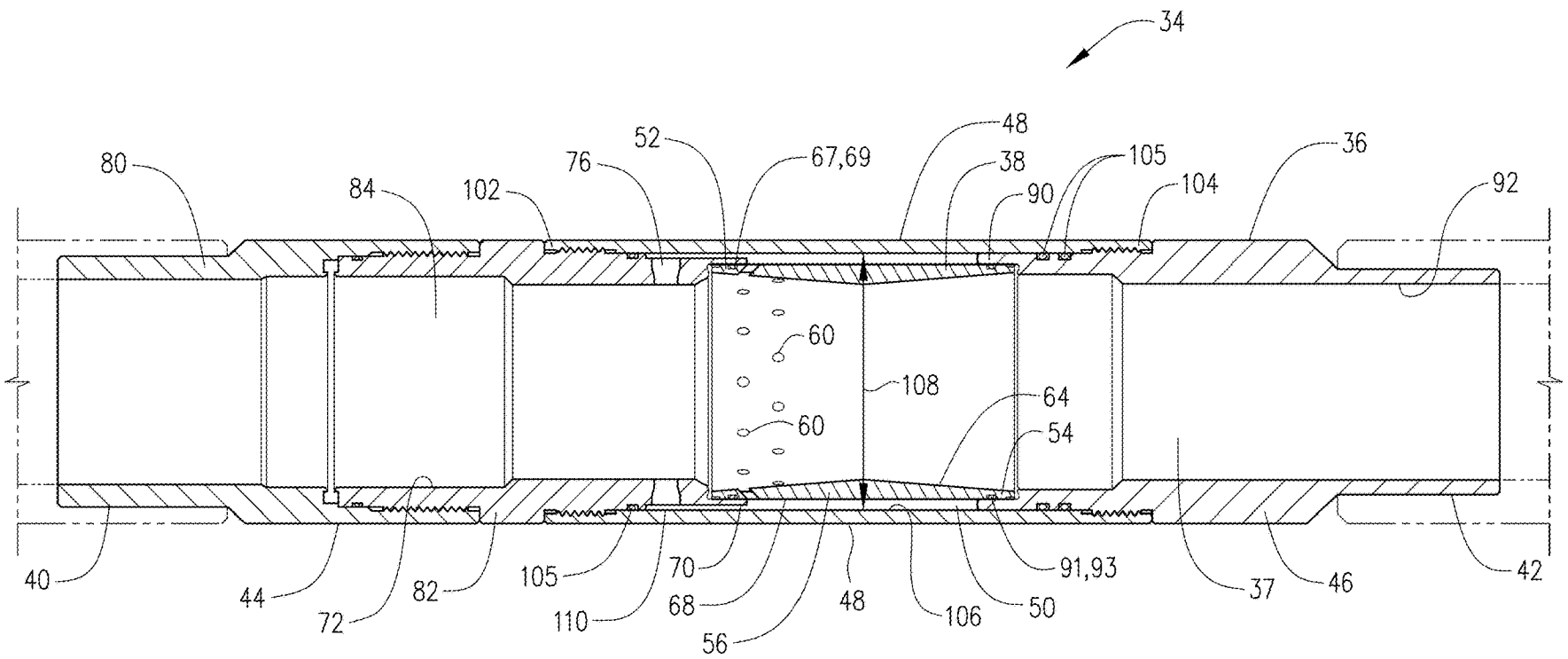
FIG. 4 is a cross section of a buoyancy assist tool of FIG. 2 after the plug has degraded and the plug and debris barrier removed from the buoyancy assist tool.
Figure 5:
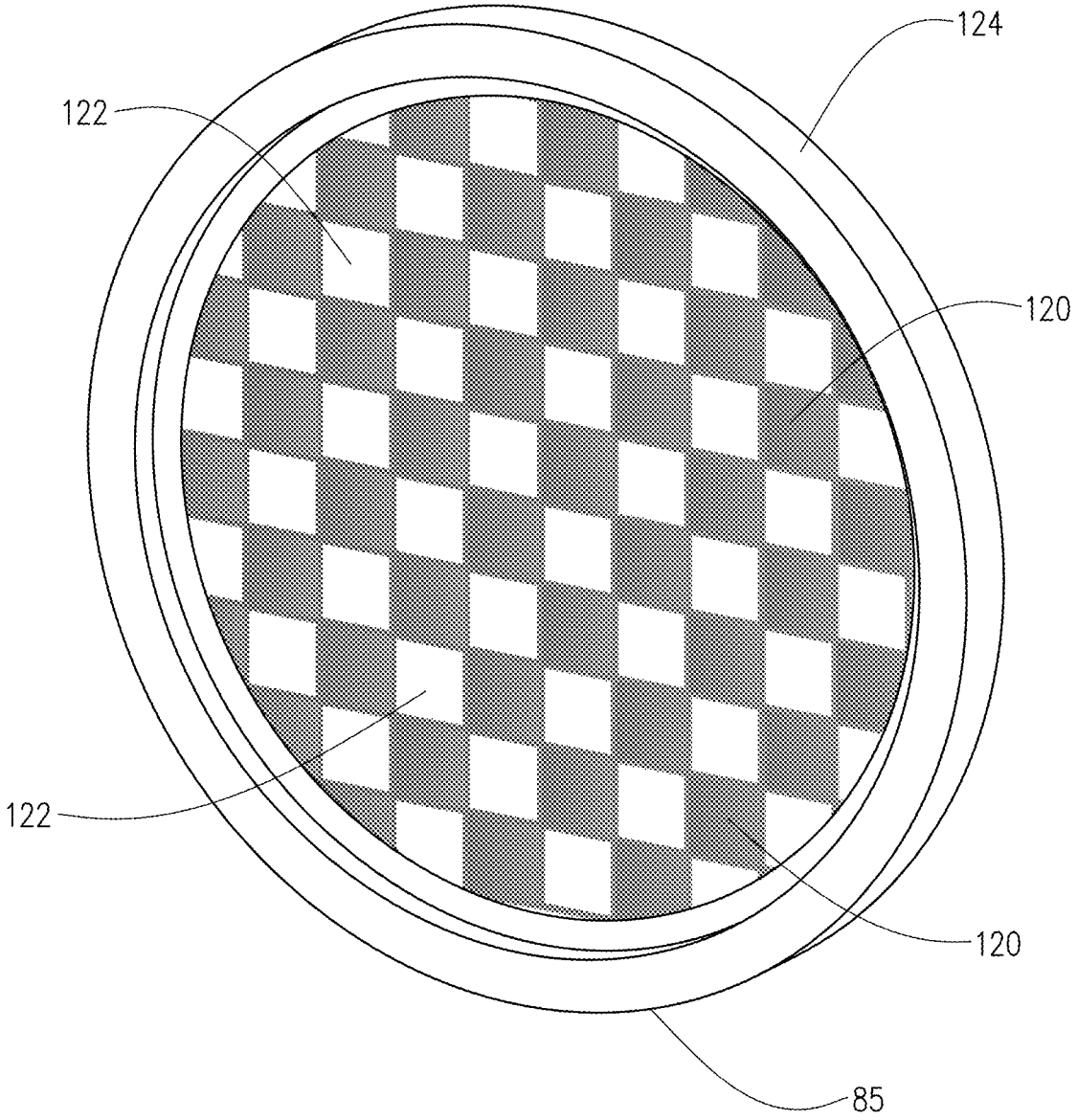
FIG. 5 is a perspective view of the debris barrier.

Debris barrier 85 is a flexible barrier. The flexible barrier is comprised of a flexible membrane 120 with a plurality of fragments 122 interspersed therein. Flexible membrane 120 is comprised of a stretchable first material and the plurality of fragments is comprised of a second material, dissimilar from the first material. Fragments 122 may be for example square fragments. The fragments can be other shapes as well, such as circular, or other geometric shapes. A non limiting example is shown in FIG. 5, in which the fragments 122 are interspersed to form a waffle, or checkerboard pattern. The first material for flexible membrane 120 may be for example an elastomeric material. The second material may be a rigid, brittle material which may be a phenolic, ceramic or other brittle material. Brittle is used herein as it is commonly understood, and is a material that will shatter with an impact. An outer connecting ring 124, also of an elastomer is connected to outer case 36 and connected to flexible membrane 120. In the described embodiment the connecting ring is fixed in a groove defined by upper and lower outer cases 80 and 82. As shown in FIG. 3, the flexile membrane with fragments 122 therein will bulge downwardly into fluid chamber 84. The pressure in fluid chamber 84 will increase until the predetermined pressure required to rupture disc 78 is reached.

In operation casing string 18 is lowered into well bore 12 to a desired location. Running a casing such as casing 18 in deviated wells and long horizontal wells often results in significantly increased drag forces and may cause a casing string to become stuck before reaching the desired location in the wellbore. For example, when the casing produces more drag forces than the available weight to slide the casing down the well, the casing may become stuck. If too much force is applied to the casing string 18 damage may occur. The buoyancy assist tool 34 as described herein alleviates some of the issues and at the same time provides for a full bore passageway so that other tools or objects such as, for example, production packers, perforating guns and service tools may pass therethrough without obstruction after well casing 18 has reached the desired depth. When well casing 18 is lowered into well bore 12 buoyancy chamber 26 will aid in the proper placement since it will reduce friction as the casing 18 is lowered into horizontal portion 16 to the desired location.

Once the casing string 18 has reached the desired position in the well bore, pressure is increased and fluid pumped through the casing string 18. The pressure will cause debris barrier 85 to bulge downwardly into fluid chamber 84 to apply a downward pressure to the fluid in chamber 84 until at a predetermined pressure rupture disc 78 bursts. Once rupture disc 78 bursts, degrading fluid from fluid chamber 84 will pass through port 76 into passageway 110 and into annular space 50. Fluid will pass from annular space 50 through ports 60 and will contact the degradable plug 58. A sufficient quantity of the degrading fluid will be utilized to degrade degradable plug 58 so that it will be completely removed from plug housing 56.

Typically, once the degradation process reaches a certain level, the degradable plug 58 will break up, and at that point both of upper and lower membranes 62 and 63 will likewise be broken, and the pieces thereof along with pieces of the degradable plug will pass through casing string 18. The pressure in the casing string 18 will cause the flexible material 120 to be torn into small pieces, and the brittle fragments 122, along with any pieces of the flexible material 120 will pass through the casing string 18 and the flow barrier 32.

A number of embodiments are disclosed herein. In one embodiment a downhole apparatus comprises a casing string. A removable plug is positioned in the casing string and configured to block flow therethrough. A flow barrier is positioned in the casing string below the removable plug, and the removable plug and flow barrier define a buoyancy chamber therebetween. A flexible barrier is positioned above the removable plug, and the removable plug and flexible barrier define a fluid chamber therebetween. The flexible barrier is comprised of a stretchable first material with a plurality of fragments of a second material interspersed therein. The fragments may comprise a plurality of generally square-shaped fragments, and may be arranged in checkerboard pattern. Other shapes such as circular or other geometric shapes may be used as well.

An additional embodiment may comprise any of the above-described embodiments further comprising an outer case connected at upper and lower ends thereof in the casing string and forming a part thereof. The flexible barrier is connected to the outer case. The flexible barrier may include a circular connecting ring connected to the outer case and a flexible membrane connected to the circular connecting ring, the flexible membrane having the fragments dispersed therein. The removable plug may be a degradable plug in any of the described embodiments. The fragments in any of the above-described embodiments may be comprised of a rigid material.

A downhole apparatus may also comprise an outer case connectible at upper and lower ends in a casing string. A plug housing is connected in the outer case. A degradable plug is fixed in the plug housing and a flexible barrier is positioned in the outer case above the degradable plug. The flexible barrier comprises a plurality of brittle fragments embedded in a stretchable base material. The brittle fragments may be dispersed in the base material in a checkerboard pattern.

The outer case is connected in a casing string at the upper and lower ends thereof. A flow barrier is connected in the casing string below the degradable plug, and the flow barrier and degradable plug define a buoyancy chamber therebetween. The rigid fragments are sized and configured to pass through the flow barrier after degradation of the degradable plug. The rigid fragments may be made from, for example, a ceramic, a phenolic or tempered glass. The stretchable base material may be an elastomeric material. A rupture disc is in a port in the outer case, and is configured to rupture at a predetermined pressure. The port is positioned to communicate fluid from the fluid chamber to the degradable plug after the rupture disc ruptures.

A downhole apparatus may also comprise a casing string; an outer case having a removable plug connected therein connected in the casing string at upper and lower ends thereof. A flow barrier is connected in the casing string below the removable plug, and the flow barrier and casing string define a buoyancy chamber therebetween. A flexible membrane is positioned above the removable plug, and a plurality of fragments is interspersed in the flexible membrane. The flexible membrane separates fluid in the casing above the flexible membrane from a fluid in a fluid chamber defined by and between the flexible membrane and the removable plug.

The fragments in the downhole apparatus may be comprised of a material selected from the group consisting of phenolic, ceramic and tempered glass. The flexible membrane is configured to bulge downwardly into the fluid chamber upon the application of fluid pressure thereto. A rupture disc is disposed in a port in the outer case and is configured to rupture as a result of the flexible barrier bulging into the fluid chamber. The flexible membrane may have a circumferential connecting ring bonded to the outer case. The fragments may be interspersed to define a checkerboard pattern.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A downhole apparatus comprising:

a casing string;

a removable plug positioned in the casing string and configured to block flow therethrough;

a flow barrier positioned in the casing string below the removable plug, the removable plug and flow barrier defining a buoyancy chamber therebetween; and a flexible, tearable membrane positioned across a central flow passage of the casing above the removable plug, the flexible tearable membrane comprised of a stretchable first material with a plurality of fragments of a second material interspersed therein, the removable plug and flexible, tearable membrane defining a fluid chamber therebetween, the flexible, tearable membrane configured to tear into small pieces upon the application of a fluid pressure in the casing string.

2. The downhole apparatus of claim 1, the fragments comprising a plurality of generally square-shaped fragments.

3. The downhole apparatus of claim 1, further comprising an outer case connected at upper and lower ends thereof in the casing string and forming a part thereof, the flexible, tearable membrane connected to the outer case.

4. The downhole apparatus of claim 3, further comprising a circular connecting ring connected to the outer case and to the flexible, tearable membrane.

5. The downhole apparatus of claim 1, the removable plug comprising a degradable plug.

6. The downhole apparatus of claim 1, the fragments being arranged in a checkerboard pattern.

7. The downhole apparatus of claim 6, the fragments comprised of a brittle material.

8. A downhole apparatus comprising:

an outer case connectible at upper and lower ends in a casing string;

a plug housing connected in the outer case;

a degradable plug fixed in the plug housing; and a flexible barrier positioned in the outer case above the degradable plug, the flexible barrier comprising:

a connecting ring connected to the outer case; and a stretchable, tearable membrane comprising a plurality of rigid fragments interspersed in a stretchable base material connected to the connecting ring, the stretchable, tearable membrane configured to tear upon an application of a pressure in the outer case.

9. The downhole apparatus of claim 8, the rigid fragments being dispersed in a checkerboard pattern.

10. The downhole apparatus of claim 8, the outer case being connected in a casing string at the upper and lower ends thereof, the apparatus further comprising a flow barrier connected in the casing string below the degradable plug, the flow barrier and degradable plug defining a buoyancy chamber therebetween.

11. The downhole apparatus of claim 10, the rigid fragments configured to pass through the flow barrier after degradation of the degradable plug.

12. The downhole apparatus of claim 8, the rigid fragments comprising a ceramic.

13. The downhole apparatus of claim 8, the outer case having a rupture disc in a port therein, the rupture disc configured to rupture at a predetermined pressure, and the port positioned to communicate fluid from a fluid chamber defined by the flexible barrier and the degradable plug to the degradable plug after the rupture disc ruptures.

14. The downhole apparatus of claim 8, the stretchable base material comprising an elastomeric material.

15. A downhole apparatus comprising:

a casing string;

an outer case connected in the casing string at upper and lower ends thereof, the outer case having a removable plug connected therein;

a flow barrier connected in the casing string below the removable plug, the flow barrier and casing string defining a buoyancy chamber therebetween;

a flexible, tearable membrane comprising a stretchable material with a plurality of rigid fragments interspersed therein positioned across a central flow passage of the outer case above the removable plug; and the flexible, tearable membrane separating a fluid in the casing above the flexible, tearable membrane from a fluid in a fluid chamber defined by and between the flexible, tearable membrane and the removable plug and tearable into small pieces upon the application of a fluid pressure in the casing.

16. The downhole apparatus of claim 15, the fragments comprised of a material selected from the group consisting of phenolic, ceramic and tempered glass.

17. The downhole apparatus of claim 15, the flexible, tearable membrane configured to bulge downwardly into the fluid chamber upon the application of fluid pressure thereto prior to tearing into small pieces.

18. The downhole apparatus of claim 17, the outer case having a rupture disc disposed in a port therein, the rupture disc configured to rupture as a result of the flexible, tearable membrane bulging into the fluid chamber.

19. The downhole apparatus of claim 15, the flexible, tearable membrane having a circumferential connecting ring, the connecting ring being bonded to the outer case.

20. The downhole apparatus of claim 15, the fragments defining a checkerboard pattern.

* * * * *